US006983934B1

(12) United States Patent
Knierim

(10) Patent No.: US 6,983,934 B1
(45) Date of Patent: Jan. 10, 2006

(54) PRINT MEDIA THICKNESS MEASUREMENT SYSTEM

(75) Inventor: David L. Knierim, Wilsonville, OR (US)

(73) Assignee: Xerox Corporation, Stamford, CT (US)

( * ) Notice: Subject to any disclaimer, the term of this patent is extended or adjusted under 35 U.S.C. 154(b) by 72 days.

(21) Appl. No.: 10/871,318

(22) Filed: Jun. 18, 2004

(51) Int. Cl.
*B65H 7/12* (2006.01)

(52) U.S. Cl. ..... 271/262; 271/265.04; 194/355; 209/603; 702/97

(58) Field of Classification Search ..... 271/265, 271/262, 263, 265.04; 194/335; 209/603; 702/97; 73/1.01
See application file for complete search history.

(56) References Cited

U.S. PATENT DOCUMENTS 3,603,680 A 9/1971 Barton
3,627,311 A 12/1971 Spinelli
2004/0099042 A1 * 5/2004 Gustafson et al. ..... 73/1.14

FOREIGN PATENT DOCUMENTS

JP 10-120246 * 5/1998

OTHER PUBLICATIONS

"Xerox Disclosure Journal," publication of Mar./Apr. 1983, vol. 8, No. 2, pp. 163-164.

* cited by examiner

*Primary Examiner*—Donald P. Walsh
*Assistant Examiner*—Kenneth W. Bower

(57) ABSTRACT

A low cost, fully automatic, thickness detection system, readily integrated into an existing paper path sheet transport, in which a regular and known small displacement signal is generated, compared, combined and/or superimposed on the signals from the small displacement of a sheet transport element with differences in sheet thickness. Even sub-millimeter sheet thicknesses can be measured of sheets moving through a regular sheet feeding nip with nip idler roller displacement using a low-cost sensor, where that sensor is additionally repetitively actuated by known small movements to provide calibration signals, such as those provided by plural small radius differences of a rotating idler roller shaft area which will enable existing idler and idler shaft run-out movement error noise signals to be overcome.

16 Claims, 4 Drawing Sheets

PRINT MEDIA THICKNESS MEASUREMENT SYSTEM

Disclosed in the embodiment herein is an improved and low cost system for more accurately sensing or measuring the thickness of one or more sheets, particularly for approximating the difference in thickness of different print media sheets moving in a conventional paper path of a xerographic printer, a piezoelectric thermally melted wax transfix pressure transfer printer, an ink jet printer, or other printers. In particular, a low cost fully automatic print media thickness detection system, readily integrated into an existing paper path sheet transport, having a low cost sensor, in which a regular and known small displacement signal is generated, compared, combined and/or superimposed on the signal from the small displacement of a sheet transport element with sheet thickness.

Various types of print media sheet presence detection or thickness measurement systems, or double sheet feed detectors of overlapping sheets, have been proposed in the art over many years using various technologies: pressure sensitive, acoustic, infra-red, pneumatic, piezoelectric, electrical conductivity, etc. The following patent disclosures are noted merely by way of some early examples: Xerox Corp. U.S. Pat. Nos. 3,603,680 and 3,627,311. Also noted is a "Xerox Disclosure Journal" publication of March/April 1983, Vol. 8, No. 2, pp. 163–164 by Raymond W. Huggins entitled "Paper Presence and Size Detector." Note also the commercial product discussed below.

Further as to this background, various low cost sheet position sensing technologies are known, but should not be confused with sheet thickness measurement systems, because they are not sufficiently accurate for usable sheet thickness measurements. One particularly common low cost sheet position sensing technology is optical interrupters. These consist of an LED light source and a phototransistor mounted in a housing with a gap between the two. A print media sheet or other partially opaque object moving through the gap partially blocks a varying amount of light. However, such sensors are typically used in a binary mode (0 if unblocked, 1 if blocked). While the same cheap (for example, about $0.34 each in quantity) sensors can be used in an analog fashion to measure sheet light transmission, they are not typically used as analog sensors. One reason is the wide (typically 10 to 1) range of gains (between manufacturing lots and temperature). Hall-effect magnetic sensors can be similarly cheap but inaccurate, and are also used primarily in digital (sheet presence versus absence) detection applications.

By way of further background, it is well known in the art that many printers do not work as well on thick print media as they do on normal thickness paper without changing some known printing process parameters, such as image transfer current, fusing temperatures, etc. Normal print media sheets can be approximately 0.07 to 0.13 mm thick for example, while thick print media sheets can be 0.20 mm or more thick, and are typically thus much stiffer (higher beam strength resistance to curvature). Thus, some printers have required the customer (user) to specify (and thus activate programming of parameter changes) media thickness (thick or normal media) via the machine's graphic user interface, control panel or job ticket after loading print media into a selected sheet feed tray or drawer. The consequence of not specifying thick media may be poor print quality. Or, even worse problems. For example, undetected and un-programmed thick media may cause jams in a transfix nip instead of, or in addition to, poor print quality. This is unacceptable to the customer. Yet customers often forget to program in their change in the print media they have selected to be fed for printing that particular print job. Especially intermixed print jobs, such as normal basis weight paper being printed along with the intermittent printing of heavier card stock being printed for covers, insert transparencies, etc. Thus, some form of fully automatic, rather than manual user entry, print media thickness detection is desirable for various printers.

Some printer products do have installed automatic print media thickness sensing systems for improved user convenience and printing quality. One that is known to these inventors is the Omron™ Z4D-A01 reflective displacement sensor. As understood, it uses optical triangulation to measure distance. Distance is measured to a roller or backing surface, then the distance is measured again to the print media as it passes over the roller or backing surface. The difference between these two measured distances is the indicated media thickness. This Z4D-A01 is designed to be insensitive to surface reflectivity and finish so that the nature of the print media and the backing surface is not critical. However, this system is believed to be relatively expensive at approximately $8 each even in volume. Also, other optical systems in paper paths have been known to be subject to paper lint and other common printer contaminants.

As noted, it is known that print media thickness can be roughly measured by sensing displacement of something mechanically touching the print media. (In the case of the above Omron™ Z4D-A01 sensor, only a beam of light "touches" the media.) Options include a fixed (non-rolling) follower such as the pre-heater platelets used in solid ink printers, or a rolling follower. A fixed follower has the advantage of avoiding cyclic surface positional variations or vibrations due to "run-out" of its roller or shaft mounting with rotation. However, a fixed follower contacting the moving sheets surfaces must be inherently accurate or must be calibrated during manufacturing and field service, and may have drag, contamination, vibration, or other issues. However, as noted, a rolling follower connecting to a sheet thickness sensor will produce a run-out signature or signal from its inherent manufacturing run-out tolerances on top of the media thickness signature signal, which heretofore was considered undesirable and/or rendering it unusable. That is, it is known that a gross change in print media thickness in a paper path, such as by a double-feed of overlapping sheets, can be detected to some extent by sensing the displacement of an idler roller follower engaging the sheets in the sheet path of a printer. However, it is also known that roller or shaft "run-outs," or other surface position irregularities with rotation, are potential error source problems discouraging use for accurate sheet thickness measurements.

Thickness sensing, at least for multi-picks, is also used in high-end finishers (booklet makers, etc.). It might also be useful in some mail sorting or other non-printing applications that have roller nips to move media.

A specific feature of the specific embodiment disclosed herein is to provide a method of detecting the thickness of moving sheets comprising moving such sheets through at least one sheet nip having at least one sheet-engaging roller member which may be repositioned by such sheets in proportion the thickness of such a sheet in said nip, said at least one sheet-engaging roller member operatively engaging a movement sensor system providing an electrical signal approximately proportional to said repositioning of said sheet-engaging roller member, wherein said movement sensor system is additionally repetitively actuated by known movements of a displacement system to provide calibrative electrical signals from said movement sensor system proportional to said known movements in combination with said electrical signal from said movement sensor system from said repositioning of said sheet-engaging roller member.

Further specific features disclosed in the embodiments herein, individually or in combination, include those wherein wherein said moving sheets are print media sheets moving in a paper path of a printer and movement sensor system is additionally repetitively actuated by regular sub-millimeter said movements of said displacement system; and/or wherein said at least one sheet-engaging roller member is at least a pair of idler rollers on a common shaft forming at least two said nips with at least two opposing sheet drive rollers, and wherein said common shaft is repositioned by such sheets in proportion to the thickness of a sheet in said nips; and/or wherein said at least one sheet-engaging roller member is mounted on a rotatable shaft having a variable radius area rotatably operatively engaging with said movement sensor system to provide repetitive known actuations of said movement sensor system to provide said calibrative electrical signal from said movement sensor system in combination with said electrical signal from said movement sensor system from said repositioning of said sheet-engaging roller member; and/or wherein said rotatable shaft variable radius area comprises a plural lobe cam surface; and/or wherein said rotatable shaft variable radius area comprises a three lobe cam surface; and/or wherein said operative engagement of said rotatable shaft having a variable radius area with said movement sensor system comprises a displaceable cam follower engaging said variable radius area and displaced thereby plural times in each rotation of said rotatable shaft; and/or wherein said operative engagement of said rotatable shaft having a variable radius area with said movement sensor system comprises rotating said variable radius area of said rotatable shaft at least partially within said movement sensor system; and/or a system for detecting the thickness of moving sheets comprising at least one nip through which said sheets are movable, said at least one nip having at least one sheet-engaging roller member which is repositionable by said sheets in proportion to the thickness of said sheets in said nip, and a movement sensor system operatively engaged by said at least one sheet-engaging roller member, said movement sensor system providing an electrical signal approximately proportional to said repositioning of said sheet-engaging roller member, and a thickness calibration system operatively engaging said movement sensor system with known displacements to repetitively provide calibrative electrical signals from said movement sensor system proportional to said known movements in combination with said electrical signal from said movement sensor system from said repositioning of said sheet-engaging roller member; and/or wherein said moving sheets are print media sheets moving in a paper path of a printer; and/or wherein said at least one sheet-engaging roller member is at least a pair of idler rollers on a common shaft and providing at least two said nips with at least two opposing sheet drive rollers, and wherein said common shaft is repositioned by said sheets in proportion to the thickness of a said sheet in said nips; and/or further including a rotatable shaft on which said at least one sheet-engaging roller member is mounted, said rotatable shaft having a variable radius area rotatably operatively engaging with said movement sensor system to provide repetitive known sub-millimeter displacements to said movement sensor system to provide said calibrative electrical signal from said movement sensor system; and/or wherein said operative engagement of said rotatable shaft having a variable radius area with said movement sensor system comprises positioning said variable radius area of said rotatable shaft at least partially within said movement sensor system; and/or wherein said rotatable shaft variable radius area comprises a plural lobe cam surface; and; and/or wherein said rotatable shaft variable radius area has at least three sub-millimeter radius differences per revolution of said rotatable shaft; and/or wherein said operative engagement of said rotatable shaft having a variable radius area with said movement sensor system is provided by a displaceable cam follower engaging said variable radius area and displaceable thereby plural times in each rotation of said rotatable shaft.

As described more generally above, the disclosed system provides output signals which may be analyzed with various known electronic filtering or signal analysis circuits or software programs. Such programming or software may, of course, vary depending on the particular functions, software type, and microprocessor or other computer system utilized, but will be available to, or readily programmable without undue experimentation from functional descriptions, such as those provided herein, and/or prior knowledge of functions which are conventional, together with general knowledge in the software or computer arts and the signal processing arts.

The term "reproduction apparatus" or "printer" as used herein broadly encompasses various printers, copiers or multifunction machines or systems, xerographic or otherwise, unless otherwise defined in a claim. The terms "print media" or "sheet" herein refers to a usually flimsy and thin physical sheet of paper, plastic, or other suitable physical substrate for images, whether precut or web fed. A "print job" is normally a set of related sheets, usually one or more collated copy sets copied from a set of original document sheets or electronic document page images, from a particular user, or otherwise related.

As to specific components of the subject apparatus or methods, or alternatives therefor, it will be appreciated that, as is normally the case, some such components are known per se in other apparatus or applications, which may be additionally or alternatively used herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples below, and the claims. Thus, the present invention will be better understood from this description, including the drawing figures, wherein:

Figure 1:
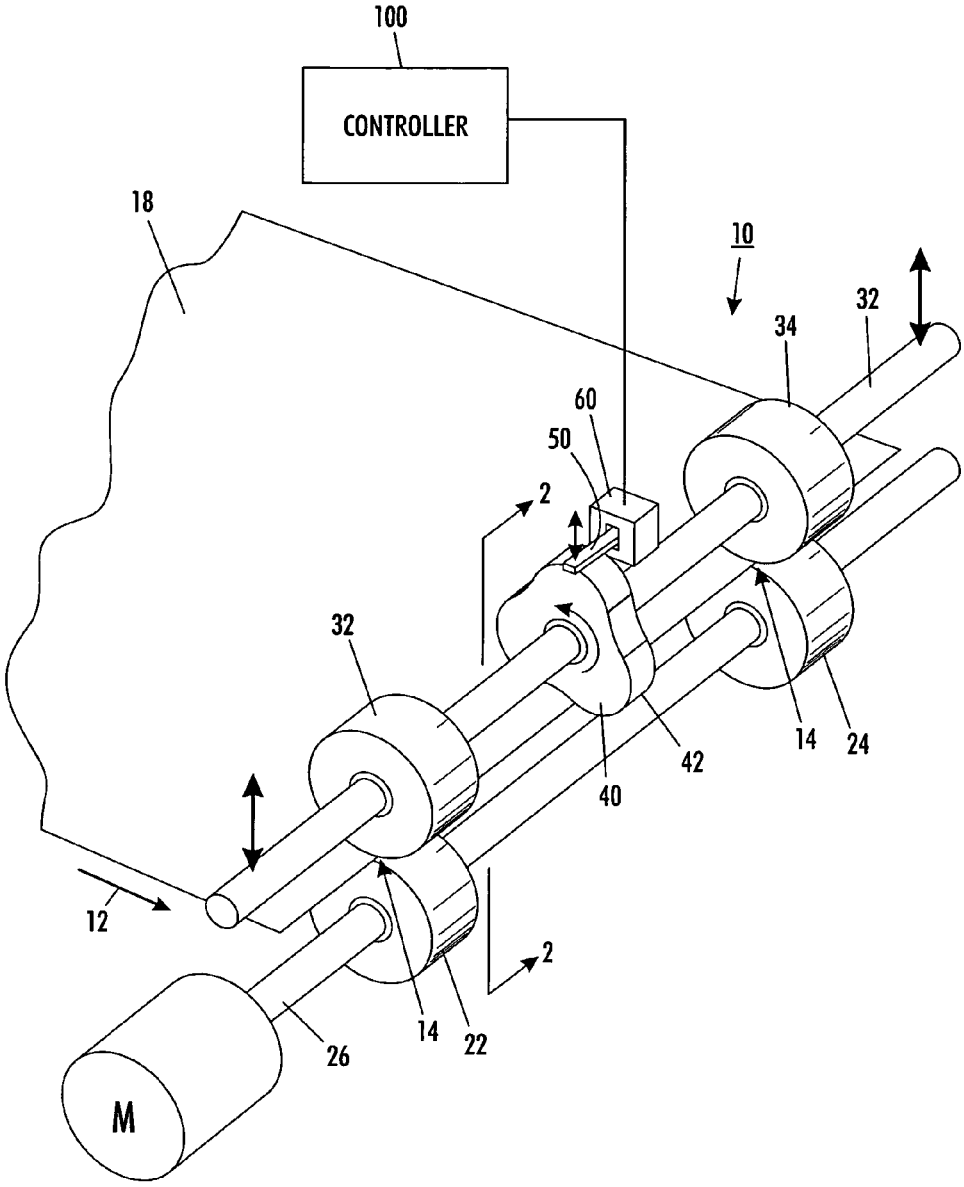
FIG. 1 is a perspective view of a portion of an otherwise conventional printer paper path schematically incorporating one example of a sheet thickness measurement system.
Figure 2:
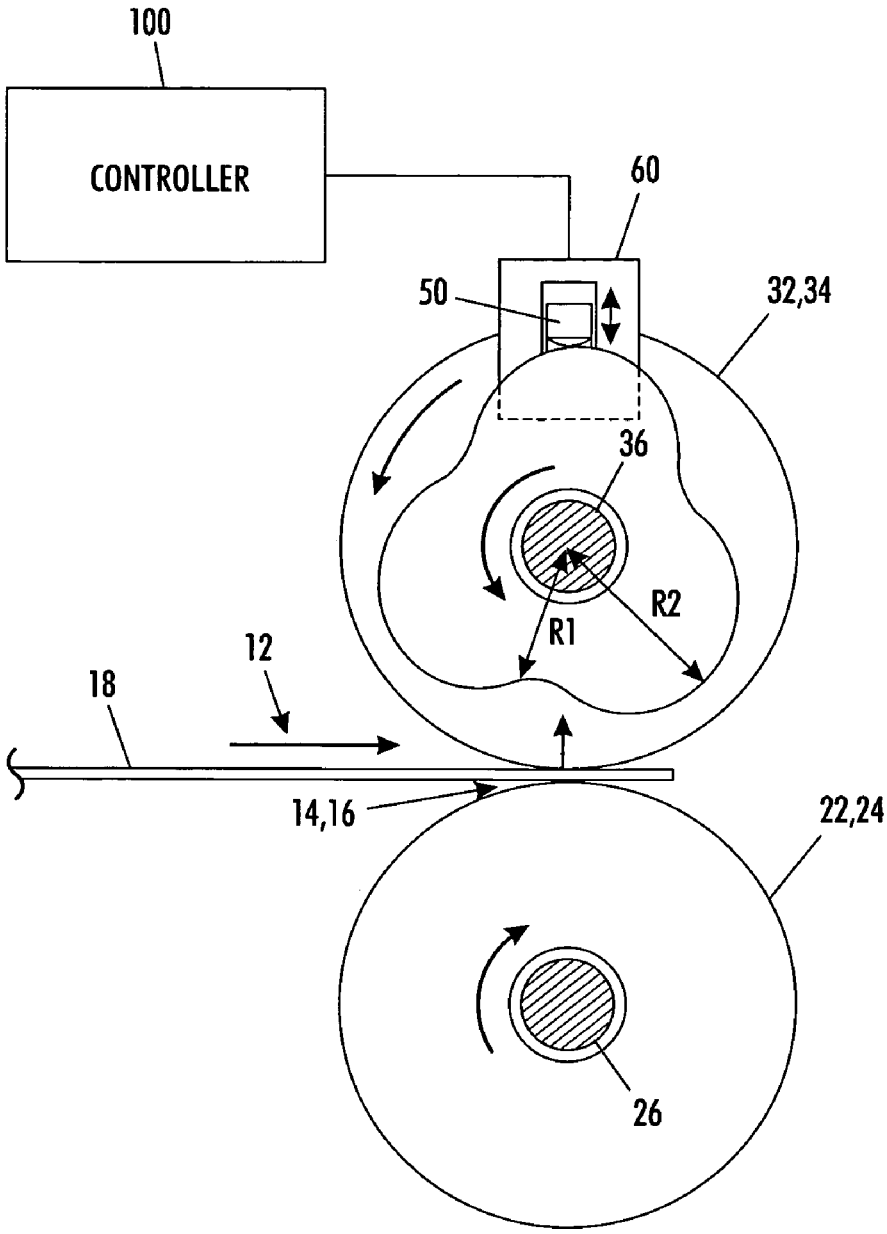
FIG. 2 is an enlarged cross-sectional side view of the example of FIG. 1.
Figure 3:
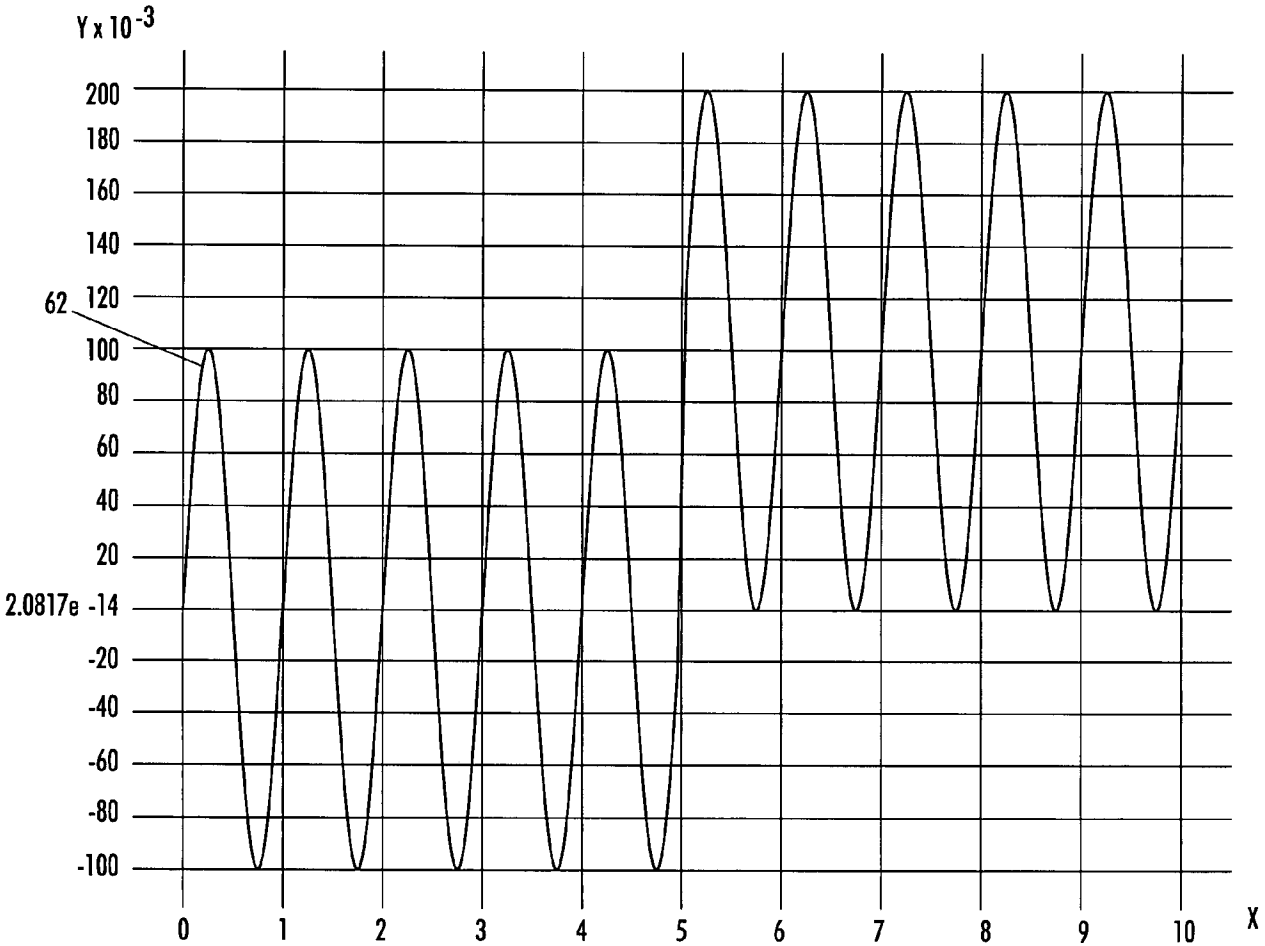
Figure 4:
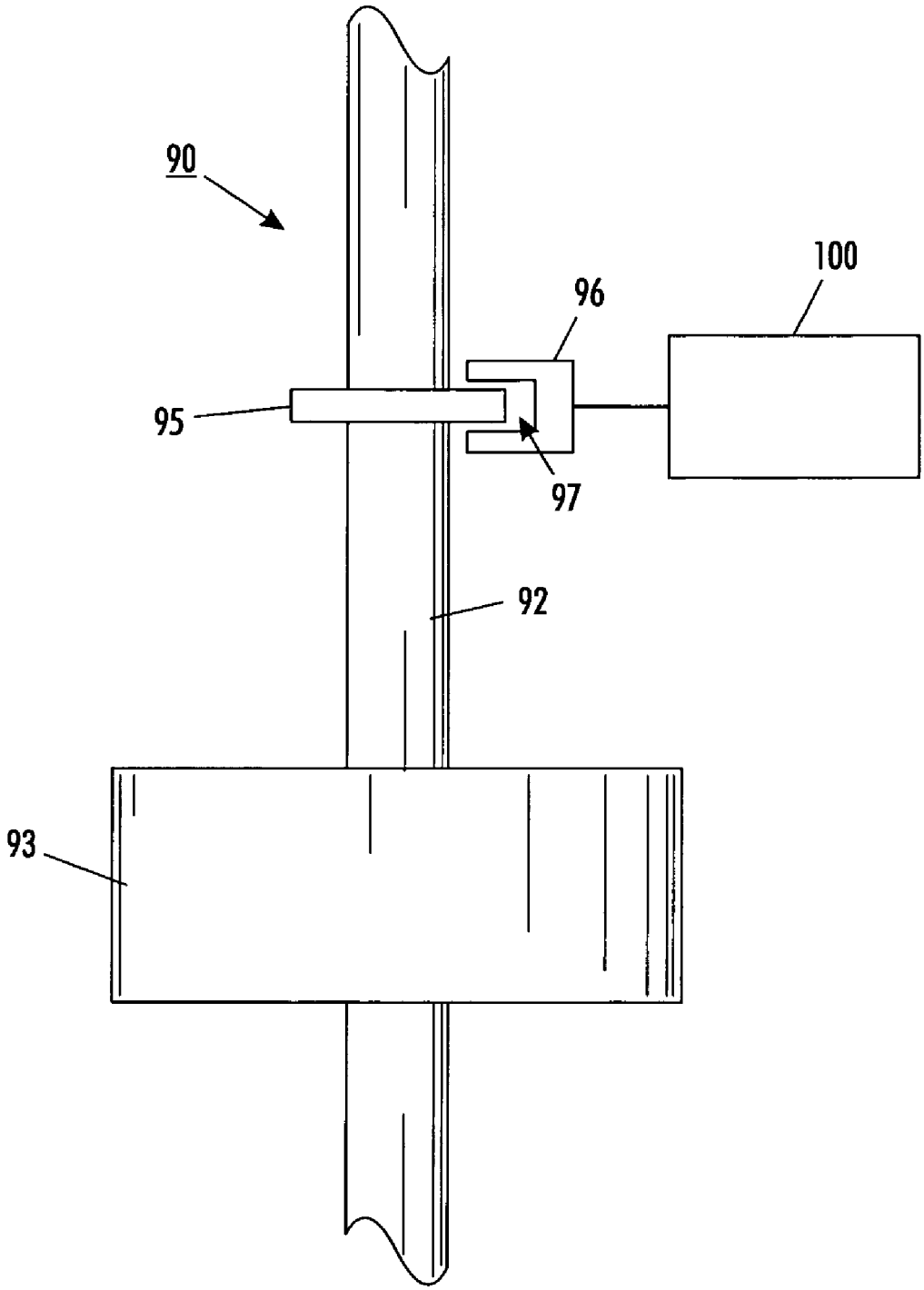

FIG. 3 is an example of an output signal of the sensor of the example of FIGS. 1 and 2, illustrating the signal shift due to media entering the nip for a cam run-out (lobe height) of 0.2 mm and media thickness of 0.1 mm; and FIG. 4 is a partial top view illustrating another example of a low cost, simple. but effective sheet thickness measurement system using a low cost commercially available type of optical sensor.

Describing now in further detail these exemplary embodiments with reference to the Figures, there is shown in FIGS. 1 and 2 an exemplary print media sheet thickness-sensing system 10 integrated into one part of an otherwise conventional printer paper path 12. In particular, the otherwise conventional sheet feeding nips 14, 16 for a print media sheet 18 in the paper path 12. The sheet feeding nips 14, 16 are conventionally provided here by drive rollers 22, 24 on a conventionally single speed driven fixed position drive shaft 26, and mating idler rollers 32, 34 on a floating idler shaft 36. For illustrative clarity, not fully illustrated here are conventional elements such as sheet path baffles, a conventional drive motor such as M for the drive rollers, and conventional spring-loading of the floating idler shaft 36 (which is mounting the idler rollers 32, 34) so that the idler rollers 32, 34 conventionally engage the drive rollers 22, 24, or a sheet passing therebetween, to form the sheet feeding nips 14, 16. The idler rollers are of course directly engaging the side of the respective print media opposite from the drive rollers. Since these components will already be present in printers, they do not add any cost to the exemplary print media sheet thickness-sensing system 10.

Schematically shown in this FIGS. 1 and 2 example, mounted on, rotating with, and floating with, the idler shaft 36 (see the movement arrows) is a three lobe cam 40. As otherwise described herein, this cam 40 need not be an added component, it may be machined or otherwise formed into the idler shaft 36 itself. The difference in radius of the cam 40 outer or cam surface 42 between the cam lobes or high area radii R2 versus the cam 40 low areas radii R1 (see FIG. 2) can be quite small, for example, on the order of only 0.1 to 0.3 mm. This small sub-millimeter dimensional change is not depicted to scale here in this example; it is greatly exaggerated for illustrative clarity. A preferred real cam would not need any concave surface sections, and would be so subtly out of round as to be difficult to show in proportion. Allowed manufacturing tolerance on the cam may be a primary reason to bias its run-out higher towards 0.3 mm end. However, using up too much of the sensor's position sensing range would be one reason to not go substantially higher. Small cam surface 42 perturbations or variation provides a known displacement of a simple cam follower 50 riding on the cam surface 42. The cam follower 50 is part of or operatively connecting with a fixed position low cost movement sensor 60. Cam follower 50 (and sensor 60) would more likely be perpendicular to the idler shaft 32 (instead of parallel, as shown here). That way friction force between the follower and the cam would not tend to cock the follower sideways, but rather just pull or push it. Also, the cam would preferably be a much smaller diameter (as close to the shaft diameter as feasible, if not ground or molded onto the shaft itself). That way the cam surface velocity would be lower and cam surface roughness would cause less follower vibration. The cam follower 50 is a part of or operatively connecting with a fixed position low cost movement sensor 60. In this case, there are three such cam follower 50 displacements per revolution of the idler shaft 36 due to using a three-lobe cam. As schematically illustrated in FIG. 3, this can provide a corresponding regular height and regular frequency calibration electrical signal output 62 from the low cost movement sensor 60 to which the cam follower 50 is connected or is an integral part thereof. This signal 62 can be recorded and/or analyzed in a programmed conventional microprocessor controller 100, or other circuitry.

As further shown by the signal 62 level change in FIG. 3, when a print media sheet 18 enters the sheet feeding nips 14, 16, the sheet 18 displaces (by approximately the thickness of the sheet 18) the idler rollers 32, 34, and hence their floating idler shaft 36. That displacement of the idler shaft 36 additionally displaces the cam follower 50 and thus additionally displaces the mechanical input to the movement sensor 60, and thus additionally displaces the output signal 62 of the movement sensor 60 by an amount corresponding to the sheet 18 thickness. That additional displacement signal from the thickness of the sheet 18 can be readily compared to the signals 62 from the known sensor 60 displacements output signals (from the dimensionally known cam lobes) to calibrate and provide a more accurate sheet thickness measurement. When a thicker sheet 18 is in the nips 14, 16 there will be a greater idler shaft displacement and thus a greater sensor displacement and signal. When a thinner sheet 18 is in the nips 14, 16, there will be a lesser displacement and a lesser signal level change. FIG. 3 shows a sheet thickness offset shift in a sine wave signal 62, but the roller run-out and vibration (which would confuse FIG. 3) are not shown. The sine wave signal 62 may shift somewhat in amplitude as well if the sensor is non-linear (as low cost sensors usually are). The algorithm may average the sine wave amplitudes with and without media to correct for this non-linearity.

The disclosed and other embodiments overcome the above-noted run-out, sensor variation, and other inherent problems to provide improved accuracy automatic sensing of print media sheet thickness with a rolling follower system contacting the moving sheets. Providing a known rotational positional change relative to the uncontrolled existing run-out pattern, such as that provided by the plural lobe dual radius cam surface 42, may be build into (or onto) the idler shaft 36 for the idler rollers engaging the sheet 18 to calibrate or more accurately measure the idler shaft positional change due to different thickness sheets. As shown, it may be made part of a normal existing sheet feed nip system. A simple cam follower and low cost motion sensor (for example, a $0.34 or so optical interrupter or a Hall effect sensor and magnet) system can be used to measure the motion of the idler shaft due to both inherent run-out and paper thickness variations, plus the additionally deliberately imparted known and regular periodic motion of the plural lobe cam. The low cost motion sensor need not be very accurate (perhaps having only a 10 to 1 range of gains).

Turning now to the other example 90 of FIG. 4, a portion of an idler shaft 92 with an idler roll 93 is shown in a top view. The system 90 may also provide an otherwise conventional sheet feeding nip and other features of the embodiment of FIGS. 1 and 2. In this system 90 no follower is needed. A thin disk 95 is part of the idler shaft 92 and directly interfaces with a conventional optical sensor 96 by variably partially blocking the conventional optical sensing slot area 97 of this optical sensor 96. Thus, variably changing the amount of light passing through the light path from the LED emitter on one side of the optical sensing slot area 97 that is being received by the photosensor on the opposite side of that optical sensing area 97. The disk 95 can also have a slightly triangular shape with three rounded edges or corners providing the regular known variable radius with rotation input to the sensor 96 superposed on the input from the idler shaft 92 movement proportional to the sheet thickness. Or, small notches could be spaced around the edge of the disc 95 to produce regular square wave signals, which could provide additional signal processing distinctions. It could provide more redundant, higher frequency, signals more easily differentiated from runout.

If the optical sensor 96 is obtained with an optical sensing slot area or gap 97 that is wider than the diameter of the idler shaft 92, then it would be preferable, as described elsewhere here, to form the regular variable radii area, such as a slightly triangular shape, in the surface of the idler shaft 92 itself, with that area of the idler shaft extending through and at least partially rotating within the sensor gap, rather than to utilize an extending disc such as 95. In this case, sensor 96 would be rotated 90 degrees and moved to the left relative to its depicted position in FIG. 4, such that the shaft would pass at least partially through the sensor gap.

For a typical optical interrupter sensor such as 96, an LED current of 20 mA may produce a phototransistor current of 2 to 20 mA when the optical path is fully unblocked. This 2 mA to 20 mA variation is caused by temperature (generally lower current at higher temperature) and by manufacturing variations in both the LED and phototransistor. Whatever this unblocked current is, it reduces to almost zero as the optical path is blocked by a flag. The rate of change of current with flag position depends not only on this unblocked current, but also on the geometry of the apertures built into the sensor housing in front of the LED and phototransistor. The aperture and flag geometry will be designed to keep the optical path partially blocked over the intended operational range of flag positions. If the optical path were to become either fully blocked or fully unblocked, then obviously the current would no longer change with flag position. For typical aperture geometries (generally rectangles), the position sensor's gain (current change per flag position change) will be highest when the optical path is half blocked, dropping off as the optical path approaches fully blocked or fully unblocked. (Gain vs. position will look something like a Gaussian, perhaps with a little bit more flat top portion in the center.)

The extent of displacement of the cam follower due to the thickness of print media entering the nip may be measured by the sensor relative to the periodic displacements caused by the known run-out movements of the idler shaft and its idlers. This can yield an accurate measure of media thickness in spite of an inaccurate and low cost sensor. This artificially deliberately induced additional known run-out signal from the dimensionally know cam radius differences or lobes (if one can call that a "run-out"), can be used to calibrate even an otherwise quite inaccurate low cost position sensor. This intentionally introduced "run-out" provides a highly desirable calibration signal for the position sensor. Especially with improved signal distinguishing between the intentionally induced run-out signals and the normal or unintentional run-out induced signals, as is additionally disclosed herein.

Improved signal distinguishing is provided in this example by first noting that the largest sources of the unintentional run-out induced signals tend to occur once per revolution or twice per revolution (even for the harmonics). By making the intentional artificial run-out signals occur at different cycle times from those, such as three times per revolution, with a three lobe cam surface, those signals can be much more readily separated or filtered in various know manners from the unintentional normal run-out. This signal separation can be further enhanced by having drive rollers and idler rollers of the same diameter, or of a diameter ratio that does not cause even the drive roller harmonics to fall on the third harmonic of the idler roller run-out.

A proposed possible example algorithm is provided below. This proposed example assumes that all nip drive components rotate an integer number of times per idler roller rotation, not a fractional number (such as ½), and not three:

Before media enters the nip, take N (perhaps 12) evenly spaced (in idler roller rotation distance, which is evenly spaced in time if the velocity is constant as it usually is), readings of the sensor spanning (N−1)/N of a rotation of the idler roller. The readings correspond to idler roller angular positions of 0 degrees, 1*360/N degrees, 2*360/N degrees, up to (N−1)*360/degrees (where 0 degrees is arbitrarily defined as the idler roller position at which the first reading was taken). Repeat this procedure after media has entered the nip. Calculate the DC term and third harmonic amplitude of a discrete Fourier transform of each data set. Report media thickness as half the intentional (three per revolution) cam run-out times the difference of the DC terms divided by the sum of the third harmonic amplitudes (this could be off by a factor of 2.)

Mentioning Fourier transform does not mean this is a complex algorithm requiring a digital signal processor or other high-powered computing platform. The data sets are very small. Eight-bit math provides sufficient accuracy, and only three terms of each transform are required. The DC term is just the average value of the readings. The third harmonic amplitude is the square root of the sum of the squares of the two third harmonic terms. (Look-up tables would suffice for square and square root.) The third harmonic terms are just 1/N times the sums of products of three cycle sine and cosine waves with the data samples. For the special case of N=12, the three cycle sine and cosine waves have only values of 0, +1, and −1. So, no multiplying is required (except for the squaring, which can be done with a look-up table if needed). The 1/N factors in the DC and third harmonic terms cancel in the final divide. So, only a single divide is required. This ends up being very little computation.

A higher sampling frequency (N>12) would help reduce vibration sensitivity (reduce sensitivity to high frequency noise in the position readings). To reduce computation, the readings could be grouped and averaged down to a set of 12. For example, if 192 readings (16*12) are taken, each successive set of 16 readings could be averaged down to a single reading. This yields 12 readings for the calculation. Vibration (high frequency noise) rejection is not quite as good with this averaging as it would be with N=192, but much better than with N=12 and no averaging. (This averaging will reduce the third harmonic measurement by 10% (sqrt(8)/PI). This reduction is a simple scale factor that can be easily handled in the calculation by using an adjusted (reduced by 10%) value for the cam run-out.)

As noted, exemplary implementations can include axially mounting on the idler shaft a three lobed cam, or providing the same kind of cam by making a section of the steel (or plastic or other material) idler roller shaft itself (which will be engaged by the motion sensor) very slightly triangular. That is, a triangular shaft cross-section with very rounded corners in that selected area. There could alternatively be five, seven or other odd numbered such cam radius high-low transitions instead of three as shown, or even numbers if the idler rollers and shaft do not have significant unintentional run out at the chosen harmonic. Another variation is for the slightly triangular section of the shaft to directly interrupt the optical path of a photo sensor, rather than moving follower or a flag that partially blocks the sensor's optical path. In this case, the optical path would be perpendicular to the shaft. Or, a thin cam on the shaft could interrupt a sensor optical path parallel to the shaft. Yet another variation is for a steel shaft to directly vary the magnetic flux through a Hall effect sensor placed between a magnet and the shaft (or other variations on magnetic paths through the shaft). These latter variations involve no wear mechanism.

A cam follower, if used, may be a simple plastic arm or extension that is mounted to ride on the variable radius cam surface. The extension portion of the cam follower operatively engaging with the motion sensor may have a variable density area or flag that moves in an optical interrupter slot, or the cam follower may moves a small magnetic element near a Hall effect sensor.

Note that neither an add-on odd-lobed cam or the equivalent odd-lobed cam formed by machined triangular dimensions of the idler shaft will be subject to significant wear, and this will not significantly dimensionally change during the life of the printer. Wear on a lightly-loaded plastic cam follower is not critical, as it would change only the average or central follower position, not the relative distance between the maximum and minimum positions of the cam follower. This relative distance will still correspond to the maximum and minimum radius positions of the cam. Also, changes in position caused both by the run-out and by media will still be the same.

In summary, disclosed is a low cost thickness measurement system that is believed to be able to utilize a very low cost optical, magnetic or other positional sensor, in a normal low cost sheet transport system, even though the thickness of individual sheets of paper of different basis weights may be so small as to be within the range of normal run-out motions of that sheet transport system. In order to utilize such low cost sensors (which may have outputs that vary with temperature and vary from part to part), it has been shown that a simple mechanical follower may ride on a simple plural radius cam surface that turns with a conventional spring-loaded idler shaft. This idler shaft, or a cam axially mounted thereon, can be a simple prescribed cam shape causing the follower connected to the sensor to move with a known motion range and periodicity. The measurement of this known motion range may be used to calibrate the sensor output for sheet thickness measurements. As so calibrated, the motion of the idler shaft when the paper enters the nip can be sensed and correlated accurately to sheet thickness. However, the present system could also be used to improve thickness measurements of other materials, such as in manufacturing processes. As noted, the shape-imparted signal is desirably unique with respect to the signals from natural shaft and idler run-outs and other naturally occurring errors. Shown herein for that purpose is a three lobes per revolution cam pattern, but this system is not limited to that particular number. Simple signal processing can then differentiate this prescribed calibration motion from the natural run-out of the idler and the paper thickness. In effect there may be continuous calibration of the sensor via the special cam profile. Signal filtering and analysis methods may be used on the unique, regular, and different frequency output signals of the sensor. It will be appreciated that this system is also applicable to improved accuracy multi-feed or double sheet feed detection, and used even for print media transparencies for which optical transmissivity systems would be inoperative. It will be appreciated that for such utilities that detecting the thickness of moving sheets does not require a specific measurement, merely an accurate relative comparison detection between having one sheet versus more than one sheet in the nip at a time, whereas an actual sheet thickness measurement may be useful for example for even initial feeds of unknown thickness materials, by measuring the difference in idler roller position between no sheet present and a particular sheet present in the nip to sub-millimeter accuracy.

The claims, as originally presented and as they may be amended, encompass variations, alternatives, modifications, improvements, equivalents, and substantial equivalents of the embodiments and teachings disclosed herein, including those that are presently unforeseen or unappreciated.

What is claimed is:

1. A method of detecting the thickness of moving sheets comprising moving such sheets through at least one sheet nip having at least one sheet-engaging roller member which may be repositioned by such sheets in proportion the thickness of such a sheet in said nip, said at least one sheet-engaging roller member operatively engaging a movement sensor system providing an electrical signal approximately proportional to said repositioning of said sheet-engaging roller member, wherein said movement sensor system is additionally repetitively actuated by known movements of a displacement system to provide calibrative electrical signals from said movement sensor system proportional to said known movements in combination with said electrical signal from said movement sensor system from said repositioning of said sheet-engaging roller member.

2. The method of detecting sub-millimeter differences in the thickness of moving sheets of claim 1, wherein said moving sheets are print media sheets moving in a paper path of a printer and movement sensor system is additionally repetitively actuated by regular sub-millimeter said movements of said displacement system.

3. The method of detecting the thickness of moving sheets of claim 1, wherein said at least one sheet-engaging roller member is at least a pair of idler rollers on a common shaft forming at least two said nips with at least two opposing sheet drive rollers, and wherein said common shaft is repositioned by such sheets in proportion to the thickness of a sheet in said nips.

4. The method of detecting the thickness of moving sheets of claim 1, wherein said at least one sheet-engaging roller member is mounted on a rotatable shaft having a variable radius area rotatably operatively engaging with said movement sensor system to provide repetitive known actuations of said movement sensor system to provide said calibrative electrical signal from said movement sensor system in combination with said electrical signal from said movement sensor system from said repositioning of said sheet-engaging roller member.

5. The method of detecting the thickness of moving sheets of claim 4, wherein said rotatable shaft variable radius area comprises a plural lobe cam surface.

6. The method of detecting the thickness of moving sheets of claim 4, wherein said rotatable shaft variable radius area comprises a three lobe cam surface.

7. The method of detecting the thickness of moving sheets of claim 4, wherein said operative engagement of said rotatable shaft having a variable radius area with said movement sensor system comprises a displaceable cam follower engaging said variable radius area and displaced thereby plural times in each rotation of said rotatable shaft.

8. The method of detecting the thickness of moving sheets of claim 4, wherein said operative engagement of said rotatable shaft having a variable radius area with said movement sensor system comprises rotating said variable radius area of said rotatable shaft at least partially within said movement sensor system.

9. A system for detecting the thickness of moving sheets comprising at least one nip through which said sheets are movable, said at least one nip having at least one sheet-engaging roller member which is repositionable by said sheets in proportion to the thickness of said sheets in said nip, and a movement sensor system operatively engaged by said at least one sheet-engaging roller member, said movement sensor system providing an electrical signal approximately proportional to said repositioning of said sheet-engaging roller member, and a thickness calibration system operatively engaging said movement sensor system with known displacements to repetitively provide calibrative electrical signals from said movement sensor system proportional to said known movements in combination with said electrical signal from said movement sensor system from said repositioning of said sheet-engaging roller member.

10. The system for detecting the thickness of moving sheets of claim 9, wherein said moving sheets are print media sheets moving in a paper path of a printer.

11. The system of detecting the thickness of moving sheets of claim 9, wherein said at least one sheet-engaging roller member is at least a pair of idler rollers on a common shaft and providing at least two said nips with at least two opposing sheet drive rollers, and wherein said common shaft is repositioned by said sheets in proportion to the thickness of a said sheet in said nips.

12. The system of detecting the thickness of moving sheets of claim 9, further including a rotatable shaft on which said at least one sheet-engaging roller member is mounted, said rotatable shaft having a variable radius area rotatably operatively engaging with said movement sensor system to provide repetitive known sub-millimeter displacements to said movement sensor system to provide said calibrative electrical signal from said movement sensor system.

13. The system of detecting the thickness of moving sheets of claim 12, wherein said operative engagement of said rotatable shaft having a variable radius area with said movement sensor system comprises positioning said variable radius area of said rotatable shaft at least partially within said movement sensor system.

14. The system of detecting the thickness of moving sheets of claim 12, wherein said rotatable shaft variable radius area comprises a plural lobe cam surface.

15. The system of detecting the thickness of moving sheets of claim 12, wherein said rotatable shaft variable radius area has at least three sub-millimeter radius differences per revolution of said rotatable shaft.

16. The system of detecting the thickness of moving sheets of claim 12, wherein said operative engagement of said rotatable shaft having a variable radius area with said movement sensor system is provided by a displaceable cam follower engaging said variable radius area and displaceable thereby plural times in each rotation of said rotatable shaft.

* * * * *